US005101554A

United States Patent [19]

Breuer et al.

[11] Patent Number: 5,101,554

[45] Date of Patent: Apr. 7, 1992

[54] PROCESS FOR PRODUCING AN ASSEMBLED CAMSHAFT AS WELL AS ASSEMBLED CAMSHAFT CONSISTING OF A SHAFT TUBE AND SLID-ON ELEMENTS

[75] Inventors: Hans-Jürgen Breuer, Overath; Wolfgang Maus, Bergisch-Gladbach; Rudolf Schulze, Munich; Helmut Swars, Bergisch-Gladbach; Hans Hanswillemenke, Cologne; Helmut Riemscheid, Wahlscheid; Karl Weiss, St. Augustin; Herbert Frielingsdorf, Lohmar; Engelbert Schwarz, Ruppichteroth; Heribert Grewe, Overath; Klaus Greulich, Heimerzheim, all of Fed. Rep. of Germany

[73] Assignee: Emitec Gesellschaft für Emissionstechnologie mbH, Lohmar, Fed. Rep. of Germany

[21] Appl. No.: 640,578

[22] Filed: Jan. 14, 1991

Related U.S. Application Data

[63] Continuation-in-part of Ser. No. 445,090, Dec. 1, 1989, abandoned, which is a continuation of Ser. No. 103,603, Oct. 1, 1987, abandoned.

[30] Foreign Application Priority Data

Oct. 1, 1986 [DE] Fed. Rep. of Germany ..... 3633435

[51] Int. Cl.[5] ..... B23P 15/00

[52] U.S. Cl. ..... 29/888.1; 29/421.1; 29/522.1; 29/523

[58] Field of Search ..... 29/6.01, 156.4, 421.1, 29/522.1, 523, 888.08, 888.1; 72/58, 370; 74/567, 568; 123/90.6

[56] References Cited

U.S. PATENT DOCUMENTS

| | | | |
|---|---|---|---|
| 4,293,995 | 10/1981 | Jordan | 29/421.1 |
| 4,575,913 | 3/1986 | Sugiuichi et al. | 29/432 |
| 4,597,365 | 7/1986 | Madaffer | 29/156.4 R X |
| 4,660,269 | 4/1987 | Suzuki | 29/523 |
| 4,750,250 | 6/1988 | Maus et al. | 29/156.4 R |
| 4,781,076 | 11/1988 | Hartnett et al. | 29/432 X |

FOREIGN PATENT DOCUMENTS

| | | | |
|---|---|---|---|
| 2336241 | 2/1975 | Fed. Rep. of Germany . | |
| 2546802 | 4/1977 | Fed. Rep. of Germany . | |
| 2400148 | 10/1977 | Fed. Rep. of Germany . | |
| 2622753 | 3/1980 | Fed. Rep. of Germany . | |
| 2922509 | 12/1980 | Fed. Rep. of Germany . | |
| 2401057 | 7/1984 | Fed. Rep. of Germany . | |
| 3227693 | 6/1985 | Fed. Rep. of Germany . | |
| 3409541 | 11/1985 | Fed. Rep. of Germany . | |
| 3530600 | 3/1987 | Fed. Rep. of Germany . | |
| 3704092 | 5/1988 | Fed. Rep. of Germany | 74/567 |
| 2351726 | 3/1977 | France . | |
| 2328108 | 5/1977 | France . | |
| 43-18278 | 2/1943 | Japan . | |
| 46-7644 | 2/1971 | Japan . | |
| 49-28298 | 7/1974 | Japan . | |
| 50-38636 | 12/1975 | Japan . | |
| 55-10303 | 1/1980 | Japan . | |
| 56-506 | 1/1981 | Japan . | |
| 148028 | 9/1983 | Japan | 29/421.1 |
| 35235 | 3/1935 | Netherlands . | |
| 1232338 | 5/1986 | U.S.S.R. . | |
| 676569 | 7/1952 | United Kingdom | 29/523 |
| 1117816 | 6/1968 | United Kingdom | 74/567 |

OTHER PUBLICATIONS

B. Ja. Masurowski, Author of "Elektrohydraulisches Impulse-inpressen von Rohren in den Rohrbö den der Wärmeaustauscher".

*Primary Examiner*—Timothy V. Eley

*Attorney, Agent, or Firm*—Toren, McGeady & Associates

[57] ABSTRACT

In the production of an assembled camshaft slid-on elements, such as control cams, bearing rings, gear wheels or bevel gears, are placed on an axially extending shaft tube. The slid-on elements are secured in place by expanding the shaft tube in the region of the elements by applying internal pressure. In producing the camshaft, a high strength material is used for the slid-on elements and an inferior strength material for the shaft. In the expanding step, an axially extending portion of the shaft tube is plastically deformed and the slid-on element is predominately elastically deformed. After expansion, the outer zone of the slid-on elements are elongated in the tangential direction in the range of 1%.

14 Claims, 3 Drawing Sheets

PROCESS FOR PRODUCING AN ASSEMBLED CAMSHAFT AS WELL AS ASSEMBLED CAMSHAFT CONSISTING OF A SHAFT TUBE AND SLID-ON ELEMENTS

This is a continuation-in-part of Ser. No. 07/445,090, filed Dec. 1, 1989 now abandoned, which is a continuation of Ser. No. 07/103,603 filed Oct. 1, 1987 now abandoned.

BACKGROUND OF THE INVENTION

1. Field of the Invention

The present invention relates to a process of producing an assembled camshaft or the like consisting of a shaft tube and slid-on elements by expanding the shaft tube in the region of the elements by applying internal pressure; it further relates to an assembled camshaft or the like consisting of a shaft tube and slid-on elements produced by expanding the shaft tube in the region of the elements as a product. The above-mentioned slid-on elements may be control cams, bearing rings and gear wheels or bevel gears which have to be connected to the shaft tube in a non-rotating and true-to-angle way.

2. Description of the Prior Art

There are prior art camshafts in which finish-machined cams and bearing rings are shrunk on to a shaft tube, following thermal processes (DE-OS 33 01 749). With such shafts the selection of the material for the elements is limited in that certain specific heat expansion coefficients of the materials are required for the shrinking process to be able to produce the necessary fits. In order to ensure sufficient tension between the shaft tube and the elements to achieve a non-rotating connection, the shaft material, too, has to meet certain more stringent requirements in respect of strength and surface hardness. Because of the necessary thermal treatments, joining the shaft tube and the elements is time-consuming and complicated. The increase in temperature in the course of the joining operation inevitably leads to a hardness loss of the elements.

There are other prior art camshafts in the case of which individual cams are slid on to profiled bars in a form-fitting way and connected to these by, for instance, shrinking, freezing, soldering, welding or glueing (DE-OS 23 36 241, DE-GM 79 20 957). This process does not permit any weight advantages as compared to conventional camshafts; modifying or adapting the angular position of the cams requires a complete redesign of the components.

It is also known to connect a camshaft consisting of a hollow shaft and longitudinally and circumferentially grooved bearing seats and cams by expanding the shaft tube section by section by applying internal pressure and pressing it into the grooves (DE-PS 25 46 802). In this case, the cams having a uniform wall thickness are tube-like so that a continuous fit on the shaft is impossible, which means that the strength of the cams does not appear to be ensured.

Finally it is known to fix internally round cams and bearing seats on a shaft tube purely by force-locking means by expanding the shaft tube along its entire length by applying internal pressure, and in order to maintain the pressure fit the tube, because of its thin walls, has to be filled with a synthetic substance (DE-PS 32 27 693). Without this additional measure it has so far not been possible to produce a secure fit capable of being torque-loaded. When expanding the shaft along its entire length there is an inherent risk of bulging in the regions between the cams, and there may be a notch effect at the end faces of the cams which reduces the strength of the shaft.

SUMMARY OF THE INVENTION

It is the object of the invention to provide an assembled shaft which can be produced by a simple and cheap production process permitting the transmission of high torques and a greater degree of freedom in selecting the materials for the shaft tube, cams and bearing seats.

The objective is achieved by providing a process characterised by the fact that the materials of the longitudinal portions of the shaft tube are subjected to plastic deformation whereas the material of the elements assumes the condition of a predominantly elastic deformation. Preferably all longitudinal portions inside the respective elements are expanded commonly at the same time. Without carrying out any thermal processes it is possible in this way to produce fits permitting a torque transmission which reaches up to 80% of the torsional strength of the shaft. The materials used for the shaft may be relatively inferior materials such as St 35 to St 52 (German Standards), whereas for the cams and bearing seats high strength materials may be used. Joining does not adversely affect the material values of either material. As the connection is effected without any external heat supply and as there is no need for heat treatment for stress relieving purposes there are no changes in the material structure adversely affecting the connection nor are there any hardness losses. In contrast to heat treatment processes, the dimensional changes which occur can be calculated. By having more freedom in selecting the material for the elements, the cam material is more easily adapted to different load conditions. It is possible to use cams and bearing seats of different materials without putting the required transmission of torque at risk. Suitable processes and devices for hydraulically expanding individual longitudinal portions can be realized easily and cost-effectively as compared to expanding a shaft by pressing in a plastics material. Such devices are described in U.S. Pat. No. 4,750,250, being multiple probes. In a further advantageous embodiment of the invention the inner cross-section of the shaft tube remains open in order to permit shaft cooling and inner lubrication of the bearing seats. The shaft in accordance with the invention is easy to assemble and provide the joining processes are taken into account accordingly it can be completed without subsequently having to grind the cams or bearing seats. The possibility of creating small distances between the elements to be fixed and of selecting materials specifically adapted to the functioning of the system permit more freedom in designing the cylinder head.

The process in accordance with the invention is particularly advantageous if, prior to expansion, the difference $U_{min}$ between the outer tube diameter $d_a$ and the inner element diameter $D_i$ is at least 0.9 times the value of the outer diameter, multiplied by the quotient of the 0.2% yield point $R_p$ and the modulus of elasticity E of the tube material. If the values are adjusted in this way it is possible to obtain the required elastic pretension in the surface layer of the aperture of the element fixed by force-locking.

The process in accordance with the invention has a further optimum feature in that the expansion of the tube takes place along an axial length portion which, at each end, extends beyond the end face of the element by a minimum of 50% and a maximum of 150% of the wall thickness. In this way it is ensured in an advantageous way that the tube wall joins the aperture of the element completely and essentially in a stress-free way along the entire length, which reduces the risk of micro-slipping and excludes the possibility of fit corrosion. At the same time, this prevents bulging of the tube with notch effects at the end faces of the elements. Special conditions arise if several elements are positioned closely together, which is the case in particular with so-called three- or four-valve engines, i.e. if three or four valves are provided per cylinder. If this is the case, the process in accordance with the invention has to be modified in that the tube areas covering two or more elements have to be expanded simultaneously. To the extent that this only takes place up to a maximum free distance between the elements of up to 40% of the wall thickness of the tube, there is no risk of tube bulging, and uniform fixing of the different elements is ensured.

In an advantageous embodiment, plastic radial surface deformation at the aperture of the elements, if a ductile material such as steel is used, reaches a material depth which amounts to approximately 10 to 15% of the smallest radial wall thickness of the elements, thereby achieving sufficiently high connecting forces without adversely affecting the strength of the elements. With hard materials such as cast materials, plastic surface deformation of this magnitude is not possible nor is it necessary. In a further advantageous embodiment, the elongation occurring in the outer zone of the element in the tangential direction after expansion should be of a magnitude of up to 1% in order to avoid any surface damage if additional loads occur when using aluminum or titanium for the element. If a ductile material such as steel is used, the preferred elongation values range between 0.1 and 0.4%, whereas with brittle materials such as cast materials the elongation values should be between 0.01 and 0.2%.

Usually and preferably, the process in accordance with the invention is carried out in such a way that expansion in the region of the cams takes place with internal hydraulic pressures of 2000 to 3500 bar whereas the internal hydraulic pressures applied for expanding the region of the more thin-walled bearing seats amount to 1000 to 2500 bar.

In a further advantageous embodiment of the process it is possible, in addition to the force locking effect, to achieve a form-fitting effect between the shaft tube and the element. With this design it is possible to allow the shaft material, in the course the forming operation, to flow into at least one, but preferably several circumferentially distributed longitudinal grooves in the aperture of the element. A further possibility of achieving a form-fitting connection consists in providing a central element portion with an increased cross-section which is followed by portions whose cross-section is tapered towards the end faces. The former embodiment primarily permits an improvement in the permanent fit under torque loads whereas the second embodiment ensures a uniform area pressure along the seat length and counteracts any inclination of the tube towards bulging in front of the end faces of the elements. Apart from the above mentioned possibilities of achieving a macro form fitting connection, it is also possible to obtain a micro form fitting connection by providing a hard particle coating on the surface of the aperture of the elements which presses itself into the tube material in the course of connection. A further method of achieving a micro form fitting connection consists in producing machining traces, especially circumferential grooves in the aperture of the element, which are intersected by the machining traces of the drawn tube on the surface, thereby providing a close connection when being pressed into each other. Machining traces in the form of point-like indentations may also be achieved particularly cheaply by sand blasting or shot peening the elements prior to joining.

By applying all of the above measures or a combination of several of them it is possible to reduce the expansion pressure required, which, in turn, permits a reduction in the remaining tolerances of form of the shaft after expansion. Furthermore, to increase service life, it is possible to use hard and brittle materials for the cams.

The invention furthermore relates to an assembled camshaft or the like consisting of a shaft tube and slid-on elements such as control cams, bearing rings, gear wheels or bevel gears, produced by expanding the shaft tube in the region of the elements by applying internal pressure, especially in accordance with one of the above-mentioned processes in the case of which the material of the shaft tube in the longitudinal portions is deformed plastically and the material of the elements predominantly undergoes elastic deformation. As described in detail, the deformation process is preferably carried out by applying internal hydraulic pressure.

According to a preferred further embodiment, the tensile strength of the shaft tube material should be 25 to 35% lower than that of the material of the elements. This favours the type of connection aimed at and, for reasons of costs, permits the selection of relatively soft shaft materials.

In an advantageous embodiment, the cams may be cast, steel or sintered elements finish-machined prior to joining, and it is possible to select materials with high hardness values such as ball bearing steel in order to improve the service life of the camshaft in accordance with the invention without adversely affecting the strength of the connection.

The basic principle of the above-explained invention may also be applied to hollow journals in boreholes, to connecting two tubes by means of a sleeve or to connecting two tube pieces inserted into each other. Some details of the invention are explained with the help of the enclosed drawing.

The Figures show the tube 1 and the slid-on element 2, a cam 2*a* and a bearing bush 2*b*. The lengths and other dimensions referred to in the claims and in the description have been given identifying letters.

DESCRIPTION OF THE PREFERRED EMBODIMENTS

Figure 1A:
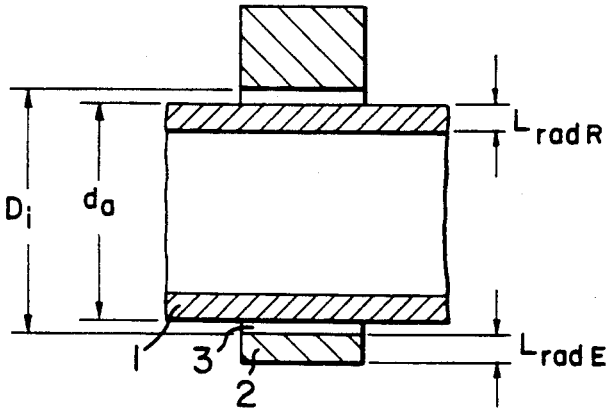
FIG. 1*a* is a longitudinal section through a connection prior to joining the cam and tube member

FIG. 1*a* shows that prior to joining, a circumferential gap 3 is provided between the tube 1 and the cam 2.

Figure 1B:
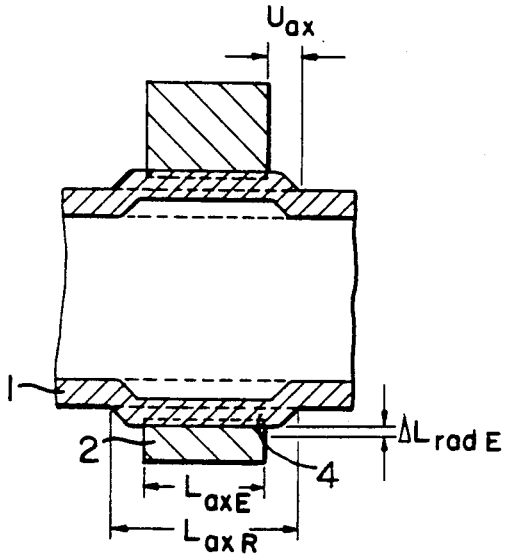
FIG. 1*b* shows a connection to FIG. 1*a* after joining
Figure 1C:
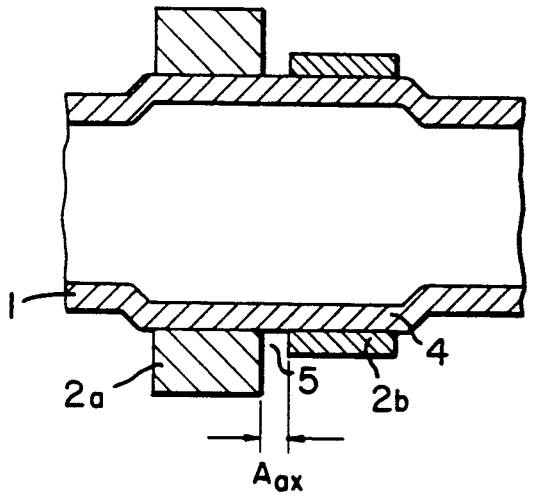
FIG. 1*c* shows a connection with two adjoining elements; and after joining.

FIG. 1*b* shows a change in the cross-section of the tube after joining, indicating in particular the limited length of the expanded tube portion 4. FIG. 1*c* shows an expanded tube portion 4 covering two adjoining slid-on elements 2*a* and 2*b*, with a small free distance 5 existing between them.

Figure 2A:
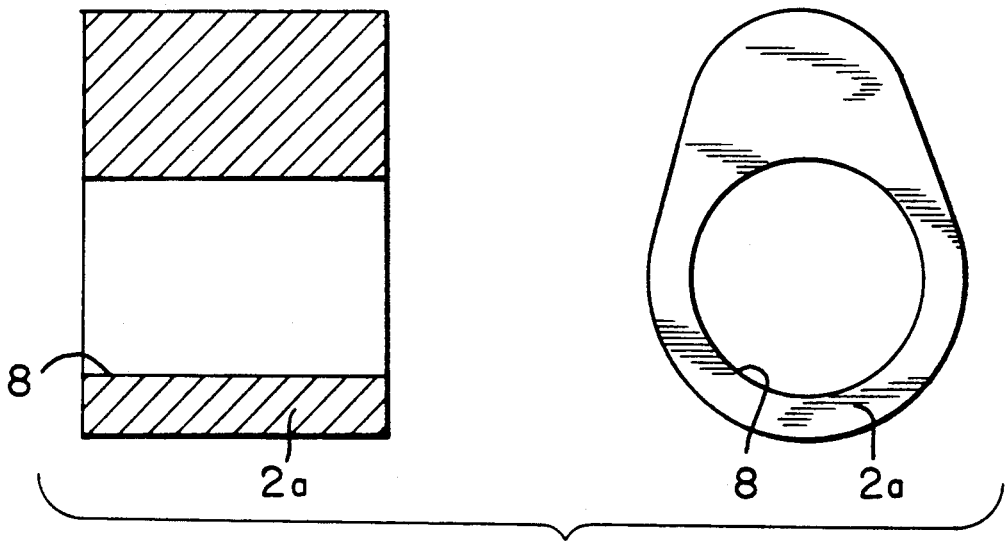
FIG. 2*a* is a longitudinal section and an end view of a corn element according to FIG. 1*a*, 1*b;*

FIG. 2*a* illustrates a cam element 2*a* of usual cross-section with an inner cylindrical bore 8.

Figure 2B:
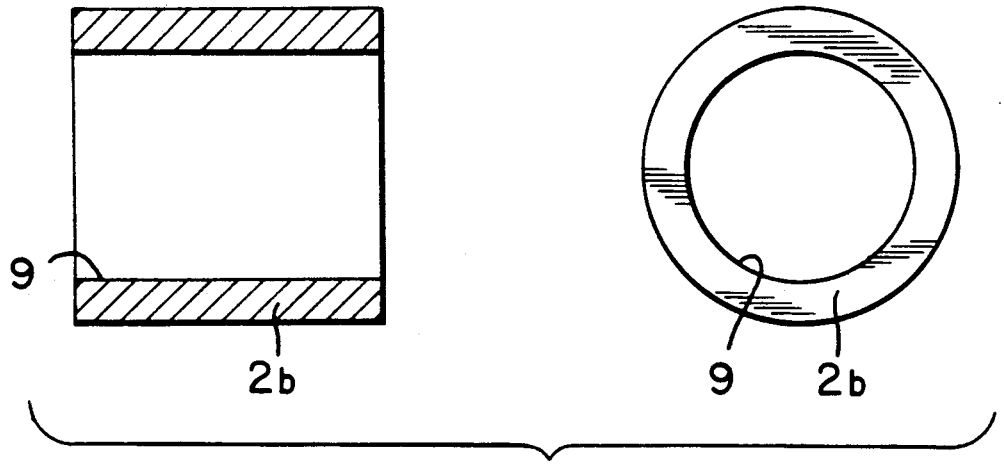
FIG. 2*b* is a longitudinal section and an end view of an element according to FIG. 1*c;*
Figure 2C:
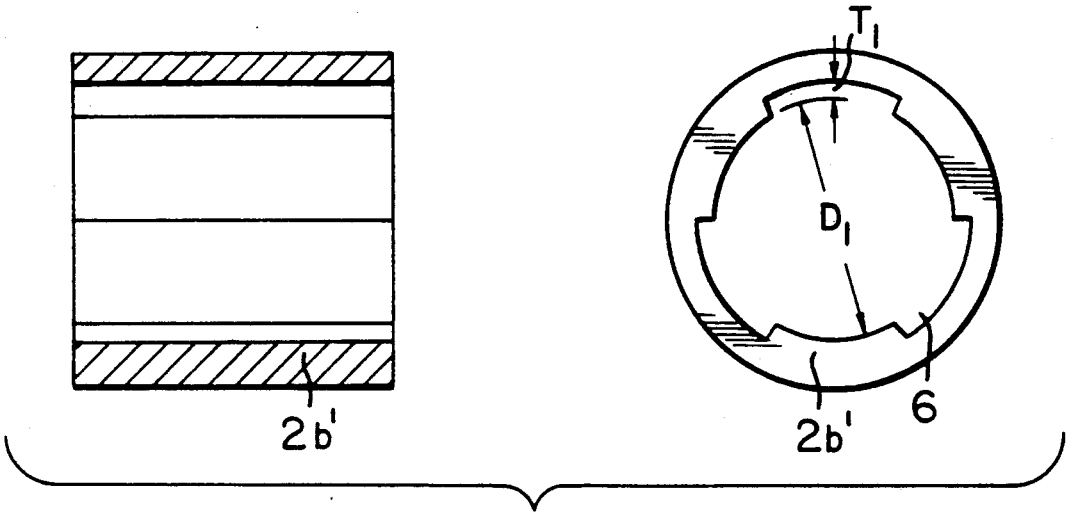
FIG. 2*c* is a longitudinal section and a cross-section of an element provided with longitudinal recesses.
Figure 2D:
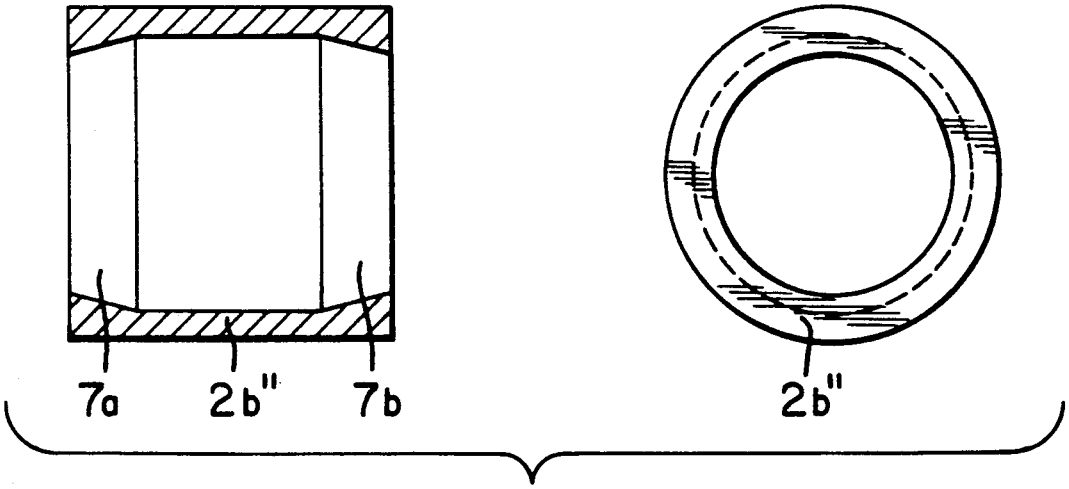
FIG. 2*d* is a longitudinal section and a cross-section of an element with a modified cross-section.

FIG. 2*b* illustrates a bearing bush 26 of usual cross-section with an inner cylindrical bore 9. FIG. 2*c* illustrates an element, 2*b* having three circumferentially distribuuted axially extending indentations 6, whereas FIG. 2*d* shows an element 2*b* with an aperture or bore having conically tapered end regions 7*a*, 7*b*.

We claim:

1. A process for producing an assembled camshaft formed of an axially extending hollow shaft tube and elements slid-on the shaft tube, such as control cams, bearing rings, gear wheels or bevel gears, by expanding the shaft tube in the region of the elements by applying internal pressure, the slid-on elements having a circumferentially extending outer zone, comprising the steps of using a high strength material for the slid-on elements and an inferior strength material for the shaft tube, in the expanding step plastically deforming an axially extending portion of the shaft tube and predominantly elastically deforming the slid-on element zone of the slid-on element and expanding the tube on an axial portion $L_{ax}$ R which, at each end, exceeds the length $L_{ax}$ E of the slid-on element by a projection $U_{ax}$ of a minimum of 50% and a maximum of 150% of the wall thickness $L_{rad\ R}$ of the tube.

2. A process according to claim 1, characterized in that prior to expansion, the difference $U_{min}$ between the outer tube diameter $d_a$ and the inner element diameter $D_i$ is at least 0.9 times the value of the outer tube diamerter $d_a$ multiplied by the quotient of 0.2% yield point ($R_p$) and the modulus of elasticity E of the tube material, in accordance with the equation $$U_{min} \geqq 0.9 d_a \times (R_P/E)$$

3. A process according to claim 1 or 2, characterized in that the expansion of the tube takes place uniformly on an axial portion covering two adjoining slid-on elements if the free distance $A_{ax}$ between the two elements is less than 40% of the wall thickness $L_{rad}$R of the tube.

4. A process according to claim 1, characterized in that in the expanding step , in addition to an adhesion locking effect, forming a form-fitting effect between the shaft tube and the slid-on element.

5. A process according to claim 4, characterized by flowing the material of the tube into circumferentially spaced indentations in the element for forming a macro-form-fitting connection.

6. A process according to claim 5, characterized by flowing the material of the tube radially outwardly into a central portion of the element aperture with an increased diameter relative to the outside for forming a macro-form-fitting connection.

7. A process according to claim 4, characterized by pressing a hard particle coating within an aperture of the element into the tube material for forming a micro-form-fitting connection.

8. A process according to claim 4, characterized by machining grooves extending axially within an aperture in the slid-on element and pressing tube material outwardly into the grooves for forming a micro-form-fitting connection between the tube and the element.

9. A process according to claim 4, characterized by pressing tube material into indentations within an aperture in the element and producing the indentations by sand blasting or shot opening for forming a micro-form-fitting connection.

10. A process according to claim 1, characterized in that in the expanding step providing plastic radial surface deformation occurs in an aperture of the element comprising steel and extends for a material depth $\Delta^{L}{}_{rad}$ in the range of 10 to 15% of the smallest wall thickness $L_{rad}$ E of the element.

11. A process according to claim 1, characterized when using a ductile material such as steel for the element with elongation in the outer zone after the expanding step in the range of 0.1 to 0.4%.

12. A process according to claim 1, characterized when using material such as cast or sintered material for the element with elongation in the outer zone after the expanding step being in the range of 0.01 to 0.2%.

13. A process according to one of claims 1, 2 and 4 to 10, characterized in that elongating the outer zone of the slide-on element in the tangential direction after expansion in the range of 0.01% to 1%.

14. A process according to claim 1, characterized in that when using one of aluminum or titanium for the element the elongation occurring in the outer zone of the element in the tangential direction after expansion is of a magnitude of up to 1%.

* * * * *